US008322691B2

(12) United States Patent
Boussaton et al.

(10) Patent No.: US 8,322,691 B2
(45) Date of Patent: Dec. 4, 2012

(54) WINCH FOR PULLING CABLES, IN PARTICULAR SYNTHETIC CABLES USED OFFSHORE

(75) Inventors: Jean-Pierre Boussaton, Aytre (FR); Karamoko Konate, La Rochelle (FR)

(73) Assignee: IMECA, Fontenay le Comte (FR)

( * ) Notice: Subject to any disclaimer, the term of this patent is extended or adjusted under 35 U.S.C. 154(b) by 555 days.

(21) Appl. No.: 12/670,167

(22) PCT Filed: Jul. 23, 2008

(86) PCT No.: PCT/FR2008/051387

§ 371 (c)(1),
(2), (4) Date: Jan. 22, 2010

(87) PCT Pub. No.: WO2009/016317

PCT Pub. Date: Feb. 5, 2009

(65) Prior Publication Data

US 2010/0224844 A1 Sep. 9, 2010

(30) Foreign Application Priority Data

Jul. 24, 2007 (FR) ..... 07 56713

(51) Int. Cl.
*B66D 1/26* (2006.01)
*B66D 1/74* (2006.01)

(52) U.S. Cl. ..... 254/278; 254/293; 242/364.2

(58) Field of Classification Search ..... 254/290, 254/278, 293, 267, 274, 287, 342; 242/388.6, 242/388.7, 390.8, 407, 364.11, 364.2; *B66D 1/26, B66D 1/74*

See application file for complete search history.

(56) References Cited

U.S. PATENT DOCUMENTS

| | | | | | |
|---|---|---|---|---|---|
| 1,170,463 | A * | 2/1916 | Smith | 254/290 |
| 3,020,022 | A * | 2/1962 | Turnquist | 254/286 |
| 3,403,578 | A * | 10/1968 | Morse | 74/500.5 |
| RE26,864 | E * | 4/1970 | Gregory | 254/386 |
| 3,576,295 | A * | 4/1971 | Hale | 242/388.8 |
| 3,843,096 | A * | 10/1974 | Wilson et al. | 254/270 |
| 4,204,664 | A * | 5/1980 | Bryan, Jr. | 254/288 |
| 6,182,915 | B1 | 2/2001 | Kvalsund et al. | |
| 7,175,163 | B2 * | 2/2007 | Blanc | 254/278 |

FOREIGN PATENT DOCUMENTS

| | | |
|---|---|---|
| FR | 1 465 703 A | 3/1967 |
| FR | 2 777 555 Al | 10/1999 |

OTHER PUBLICATIONS

International Search Report, dated Jan. 8, 2009, from corresponding PCT application.

* cited by examiner

*Primary Examiner* — Victor Batson
*Assistant Examiner* — Justin Stefanon
(74) *Attorney, Agent, or Firm* — Young & Thompson

(57) ABSTRACT

A winch (1) for pulling a cable (C) for maneuvering a load is composed of two motorized drums (3) each including an active cylindrical peripheral surface (5) equipped with several annular grooves (6), the cable intended to be wound around the two drums (3) according to a helical arrangement. The motorized drums are each formed from at least three pulleys (11), that can each be rotated around a common central axis (10), cooperating with their own dedicated motor element (4) and including a cylindrical peripheral surface equipped with at least one of the grooves: two pulleys known as outer pulleys (11*a*, 11*d*), positioned between which is at least one pulley known as a central pulley (11*b*, 11*c*). The central pulleys include at least one axial cylindrical extension, the cylindrical peripheral surface of which constitutes a rotation bearing for the central cylindrical surface of at least one of the other pulleys.

15 Claims, 3 Drawing Sheets

WINCH FOR PULLING CABLES, IN PARTICULAR SYNTHETIC CABLES USED OFFSHORE

The present invention relates to winches for pulling a cable, in particular a synthetic cable used offshore for handling a load. In particular, the present invention relates to a winch of the type having a tension-reducing function to reduce the tension to which are subjected the cables undergoing tensile stresses, in order to compensate for the phenomena of elongation created by this tension, before the cable is wound onto a storage reel.

Offshore, the loads (equipments, ducts, technical cables, valves, etc.) are very generally laid on the seafloor and taken back therefrom by means of metal cables (often made of steel), which are handled by means of pulling winches and stored on a storage reel.

During such load handling operations, the cables are subjected to high tensile stresses. And, so that they can be suitably wound onto their storage reels, the cables have to be loosened and brought back to a "low tension" state.

For that purpose, some "compact" winding/unwinding winches are composed of two motorized drums, placed opposite to each other, each comprising an "active" cylindrical peripheral surface provided with several annular grooves, juxtaposed and coaxial to each other.

The cable is wound around these two drums according to an arrangement of the helical type, passing from the annular groove of a drum to the following annular groove of the other drum. It cooperates with these drums though a phenomenon of adhesion/friction along several slip arcs; this adhesion/friction interaction and the succession of slip arcs enable the cable to be brought back, at the exit of the winch, on the storage-reel side, to a low-tension state.

The metal cables that are implemented have the advantage to be particularly strong, but they have the major drawback to be heavy weight.

This characteristic is particularly problematic when handling a load at a very great depth (several thousands of meters). Indeed, once the cable is unwound, the motor of the associated winch has to be powerful enough to pull both the weight of the unwound cable and the weight of the carried load.

In other words, the harnessable winch power for handling the load is thereby reduced by the weight of the unwound cable.

For these different reasons, an interesting solution would be to replace the metal cables by cables made of a synthetic material, for example of the polyester type.

Indeed, this type of synthetic cable has the interest to be particularly strong and light-weight, the latter characteristic being further accentuated when the cable is plunged into water (due to a phenomenon of buoyancy). Such synthetic cables have also the advantage that they can be made without real limits in length, which is particularly interesting for laying loads at very great depths. Moreover, the storage reel, associated with a synthetic cable, has a lower inertia.

However, most of the present two-drum winches, as described above, are not really usable with this type of synthetic cable.

Indeed, unlike the metal cables, such synthetic cables are highly elastic; and they undergo a significant elongation when subjected to high tensile stresses. This is the case within winches, in which they pass from a low tension, on the reel side, to a high tension, on the load side.

Furthermore, these phenomena of elongation are not actively handled and compensated for within conventional winches, which is the cause of friction with the drums, producing overheating and thus liable to deteriorate the structure of said synthetic cables, the latter being sensitive to temperature increases.

A particular structure of pulling winch, liable to compensate for the elongation stresses applied to the synthetic cables, is described in FR-2 777 555.

The corresponding winch is composed of two rows of several drums, the drums of each row being offset relative to each other, both in the radial and the axial direction. The drums each comprise their own motor and a single peripheral groove on which is wound the cable to be pulled.

In practice, the pulling power of each drum may thus be adjusted so that the local pulling power is kept at a level low enough not to damage the cable.

However, such a winch structure has the major drawback to take a very large room on the ship deck or on the platform to be equipped.

Another winch structure adapted in particular for pulling synthetic cables is described in FR-A-1 465 703.

This winch is composed of two drums placed opposite to each other, each consisting of several coaxial groove pulleys mounted on a same central axis. Herein, the central axis carries two pulleys each comprising a groove, each of said pulleys having a single lateral extension, itself serving as a bearing for another pulley with groove(s). The different pulleys are individually associated with their own motor.

Such a winch structure is not either very compact.

To remedy these problems, the applicant has developed a new winch structure adapted in particular for pulling synthetic cables, of the type of that described in the above-mentioned FR-1 465 703, which has the interest to have an optimum and more reduced overall size, and to be well-balanced, while significantly and efficiently compensating for the elongation of the pulled cable.

Accordingly, the winch for pulling a cable according to the invention is of the type having two motorized drums, placed opposite to each other, each comprising an active cylindrical peripheral surface provided with several annular grooves, juxtaposed and coaxial to each other, said cable being intended to be wound around said two drums according to an arrangement of the helical type, wherein said two motorized drums are each formed of at least three pulleys, rotationally mounted on an axial bearing shaft, around a common central axis, and each cooperating with their own dedicated motor means.

These pulleys each comprise a cylindrical peripheral surface provided with at least one of the grooves, so as to each form a portion of the active surface of drum, i.e. two so-called "outer" pulleys, between which is arranged at least one so-called "central" pulley. The central pulley(s) comprise at least one axial cylindrical extension, the cylindrical peripheral surface of which forms a rotation bearing for the central cylindrical surface of at least one of the other pulleys, corresponding to the rotation central surface thereof.

According to the invention, said or at least one of said central pulley(s) comprises two axial tubular extensions, arranged on either side of its active peripheral surface that is provided with a single groove, and each forming a rotation bearing for the central cylindrical surface of at least one of said other pulleys.

According to a particularly interesting embodiment, the cylindrical surface forming a bearing of a central pulley other than the first central pulley cooperating with the fixed axial bearing shaft corresponds to the cylindrical peripheral surface of one of the axial extensions of said first central pulley.

According to another characteristic, the or at least one of the axial extension(s) of the pulleys also serves for the connection with the dedicated motor means.

On the other hand, according to an interesting embodiment, one of the outer pulleys of the drums is provided with a single cylindrical groove, intended to receive the cable under "high tension", on the load side; and the other outer pulley comprises an array of several grooves, intended to receive the cable under "low tension", on the storage-reel side.

In this case, the outer pulley located on the storage-reel side advantageously comprises from two to five grooves.

According to still another characteristic, the two drums advantageously each comprise from two to six central pulleys, each provided with a single annular groove.

According to a particularly interesting embodiment, the two drums each comprise four pulleys:

- a first central pulley comprising, on the one hand, a central cylindrical surface cooperating with a fixed axial bearing shaft, forming the rotation bearing thereof, and on the other hand, two axial tubular extensions, forming bearings, arranged on either side of its active peripheral surface that is provided with a single groove, one of said extensions cooperating with its own dedicated motor means,
- a first outer pulley comprising a central cylindrical surface adapted to cooperate with the peripheral surface of a first tubular extension of said first central pulley, whose active peripheral surface comprises a single groove, and whose outer portion cooperates with its own motor means,
- a second central pulley comprising—an active cylindrical surface provided with a single groove, —a cylindrical central surface adapted to cooperate with the surface of the second tubular extension forming a bearing of said first central pulley, and —an axial tubular extension cooperating with its own motor means, and
- a second outer pulley provided with a central cylindrical surface adapted to cooperate with the tubular extension forming a bearing of said second central pulley, whose active cylindrical surface is provided with an array of grooves, and whose outer portion cooperates with its own motor means.

According to still another feature, the or at least one of the axial extension(s) of the central pulleys, and the outer portion of the outer pulleys, comprise an axial crown gear adapted to cooperate with at least one complementary pinion gear, driven by dedicated motor means, said crown gears being distributed on either side of the active cylindrical surface of the drums.

Particularly advantageously, the motor means associated with the outer pulley, called the master pulley, of one of the drums, located on the load side, are driven by regulation means configured in speed-control mode, and the motor means associated with the other pulleys, called the slave pulleys, are driven by regulation means configured in torque-control mode.

On the other hand, advantageously:

- the two drums are oriented angularly relative to each other, notably to avoid the twisting of the cable; for example, one of the drums is inclined by an angle of about 2° with respect to the horizontal, and the other drum is inclined, in the reverse direction, by an angle of about 1° with respect to the horizontal;
- the two drums are carried by the two vertical walls of a frame, the latter also forming the support structure for the driving motor means of the constitutive pulleys;
- the cylindrical central surfaces of the pulleys cooperate with their respective surface forming a rotation bearing, through means of the rolling bearing/ring spacer type.

The present invention also relates to an equipment for pulling a cable, comprising a winch as described above, associated with a storage reel.

The invention will be further illustrated, without being in any way limited, by the following description of a possible embodiment, and shown in the attached drawings, in which.

Figure 3:
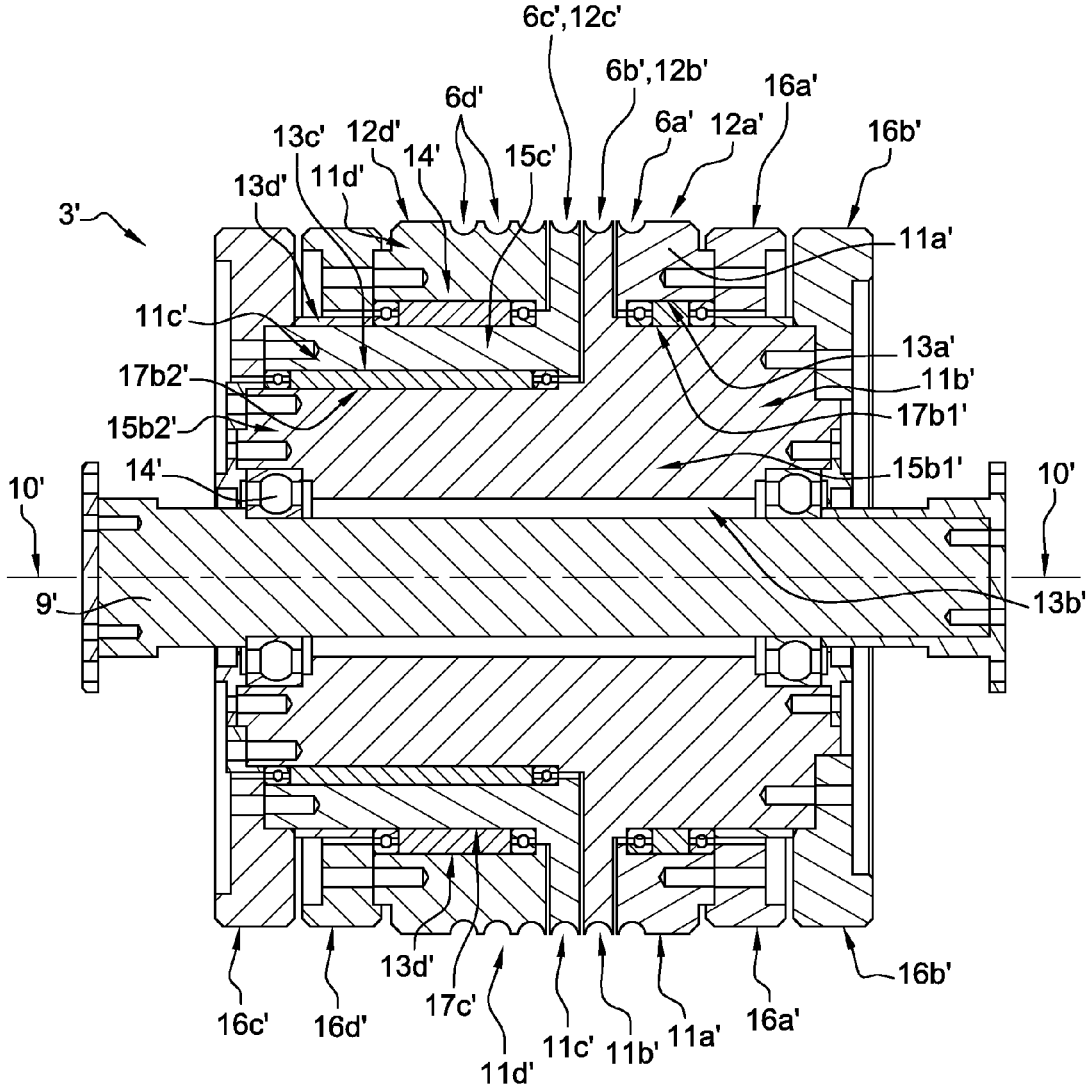

FIG. 3 schematically shows one the drums, isolated from the remaining of the winch, with a plane cross-section view passing through its axis of rotation.

Figure 1:
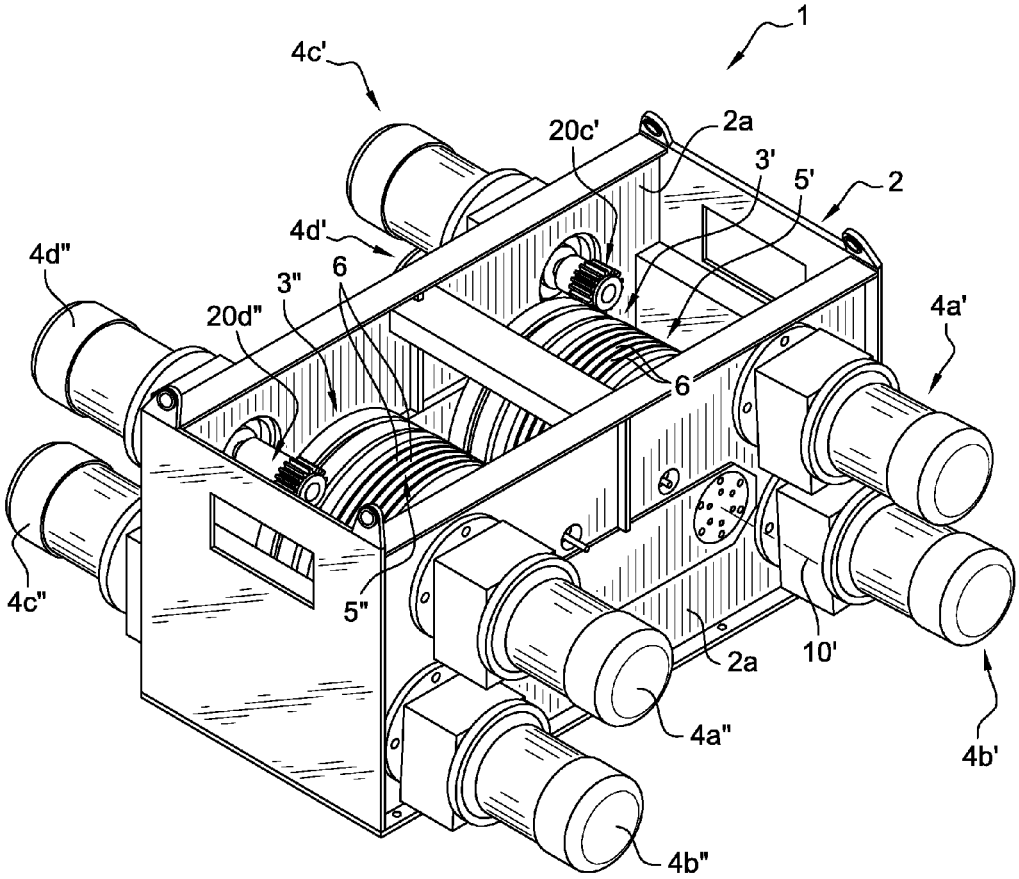
FIG. 1 is an overall perspective view of a winch according to the invention, intended to be fitted in an equipment for pulling a cable, in particular a synthetic cable used offshore for handling a load.
Figure 2:
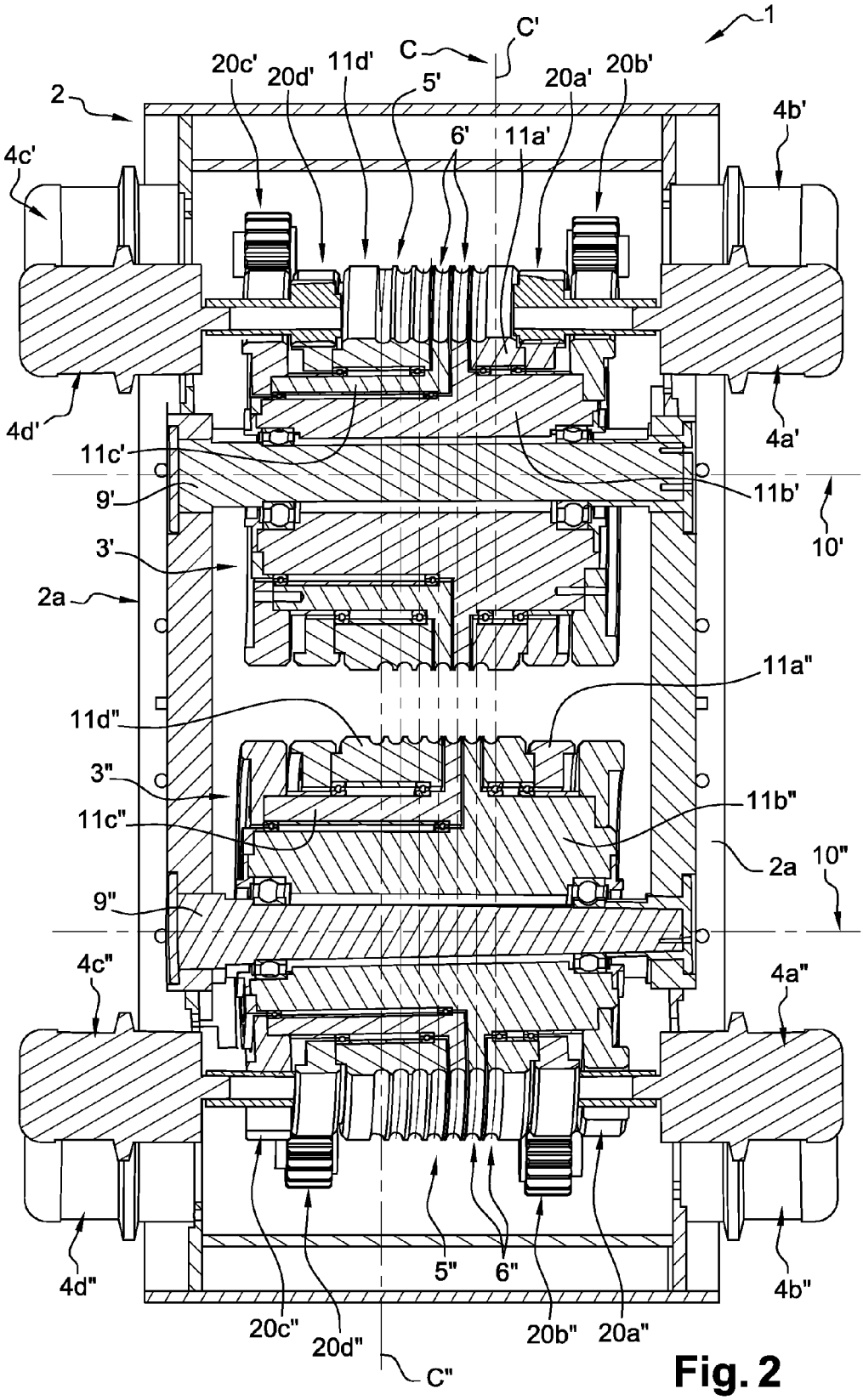
FIG. 2 is a top view of the winch according to FIG. 1, with a local sectional view of the frame and of the two associated motorized drums.

The pulling winch 1, as shown in FIGS. 1 and 2, has a structure adapted for pulling a cable C (schematically shown by a dot and dash line in FIG. 2), in particular a synthetic cable used offshore for handling a load.

This winch 1 is, conventionally, associated with a storage reel (not shown), to form together an equipment for handling a cable, that can be fitted, for example, on a ship desk or an offshore platform.

The winch 1 is composed of a frame 2 comprising two side walls 2*a*, spaced from each other and opposite to each other, between which are fitted and carried, on the one hand, two motorized drums 3' and 3" placed opposite to each other, on which is suitably wound a synthetic cable, and on the other hand, several motor elements 4 ensuring the operation of these two drums 3' and 3".

Each drum 3', 3" is herein associated with four motor elements 4 (respectively 4*a*', 4*b*', 4*c*', 4*d*' and 4*a*", 4*b*", 4*c*", 4*d*"), for being operated in rotation during the cable winding and unwinding operations.

The two drums 3' and 3" each comprise an active cylindrical peripheral surface 5' and 5", provided with annular grooves 6, whose cross-section, herein generally V or U shaped, is adapted to receive and efficiently maintain the cable wound on the winch.

Herein, the drums 3' and 3" each comprise an array of annular grooves 6, respectively six and seven, which are juxtaposed and coaxial to each other. Each array of grooves 6 is arranged in the central area of the associated drum 3', 3".

Generally, the cable C is intended to be wound around the two drums 3' and 3" according to a usual arrangement of the helical type, within each of their annular grooves 6.

This cable is intended to be associated, on a side C', with the load to be handled, thereby forming the "high tension" end thereof, and, on another side C", with the storage reel, thereby corresponding to the "low tension" end thereof.

The winding of the cable C within the grooves 6 of the two drums 3 allows the progressive reduction of the tension thereof, and by corollary of the elongation thereof.

The two drums 3 are oriented angularly relative to each other, to avoid the twisting of the cable.

In this case, one of the drums 3 is inclined by an angle of about 2° with respect to the horizontal, and the other drum 3 is inclined by an angle of about 1° with respect to the horizontal, in reverse direction relative to each another.

The present winch structure 1 has the advantage to be particularly compact, and is particularly adapted to efficiently reduce the tension of the cable and thereby to actively compensate for the elongation thereof.

For that purpose, as shown in FIG. 2, the two motorized drums 3 are each formed of a fixed axial bearing shaft 9, with a central axis 10, associated with the frame 2 of the winch 1, and carrying over its length several pulleys 11, in this case four (11*a*, 11*b*, 11*c* and 11*d*), juxtaposed and nested within each other to form together the body of the drum 3.

Each of the pulleys 11 of the drums 3 rotates around the common central axis 10 and is operated individually by its own motor means 4.

Each of them comprise a cylindrical peripheral surface 12 forming a cylindrical section of the active surface 5 of the drum 3, and they are provided with at least one of the annular grooves 6; these pulleys 11 also have a central cylindrical surface 13 intended to cooperate with a complementary cylindrical surface forming their rotation bearing.

The pulleys 11 of each drum 3 are of two types, according to their position on the length of the associated support shaft 9: two so-called "outer" pulleys 11*a* and 11*d* are located near the side walls 2*a* of the frame 2, between which, herein, are placed two so-called "central" pulleys 11*b* and 11*c*.

To simplify the following of the description, the pulleys 11 of each drum 3 are designed by the successive reference numerals 11*a*, 11*b*, 11*c* and 11*d*, from the load side to the storage-reel side.

FIG. 3 shows in detail the structure of the drum 3' provided with six peripheral annular grooves 6. The structure of the other drum 3" of the winch 1 is different from the former only in that an additional annular groove 6 is present on its outer pulley 11*d*", serving as a guide for the end of the cable C" that is connected to the storage reel.

The motor means 4*a*', 4*b*', 4*c*' and 4*d*' associated with the pulleys 11*a*', 11*b*', 11*c*' and 11*d*' of this drum 3' are shown in FIG. 2.

As shown in FIG. 3, the first central pulley 11*b*', just downstream from the outer pulley 11*a*' on the load side, comprises, on the one hand, an active peripheral surface 12*b*' provided with a single groove 6*b*', and on the other hand, a central cylindrical surface 13*b*' cooperating with the central shaft 9 forming its rotation bearing, through means 14' of the rolling bearing/ring spacer type.

The body of this central pulley 11*b*' comprises two axial tubular extensions 15*b*1' and 15*b*2', arranged on either side of its active peripheral surface 12*b*' (on the "high tension" side and the "low tension" side of the cable, respectively, to form a T-shaped half-section piece), herein intended to form the bearings of rotation of the other pulleys 11' of the drum 3'.

The annular peripheral end 16*b*' of the axial tubular extension 15*b*1' (on the "high tension" side) is structured so as to cooperate with the dedicated motor means 4*b*'; this tubular extension 15*b*1', further to constitute a rotation bearing, forms thereby a kind of transmitting structure intended to cooperate with the corresponding motor means.

The other central pulley 11*c*' comprises an "active" cylindrical surface 12*c*', also provided with a single annular groove 6*c*'.

This central pulley 11*c*' comprises a single axial tubular extension 15*c*', extending over the length of the extension 15*b*2' of the first central pulley 11*b*' (to form a L-shaped half-section piece).

The cylindrical central surface 13*c*' of this central pulley 11*c*', mainly formed by the axial tubular extension 15*c*' thereof, cooperates with the cylindrical surface 17*b*2' of the second axial extension 15*b*2' of the first central pulley 11*b*', through means 14' of the rolling bearing/ring spacer type.

Moreover, the axial tubular extension 15*c*' is provided at its end with the annular crown 16*c*' shaped so as to cooperate with its own dedicated motor means 4*c*'.

The first outer pulley 11*a*', generally crown-shaped, comprises an active peripheral surface 12*a*' provided with a single groove 6*a*', intended to cooperate with the cable under "high tension", i.e. on the side of its end connected to the load.

This outer pulley 11*a*' comprises a cylindrical central surface 13*a*' which cooperates with the peripheral surface 17*b*1' of the first tubular extension 15*b*1' of the first central pulley 11*b*' (forming its rotation bearing).

Its annular outer portion 16*a*', herein constitutive of this pulley 11*a*', is shaped so as to cooperate with its own dedicated motor means 4*a*'.

The second outer pulley 11*d*', generally crown-shaped, comprises an active cylindrical surface 12*d*' provided with an array of three grooves 6*d*', intended to receive the cable under "low tension" (on the storage-reel side).

This pulley 11*d*' also comprises a cylindrical central surface 13*d*' cooperating, through means 14 of the rolling bearing/ring spacer type, with the cylindrical surface 17*c*' of the tubular extension 15*c*' (forming a bearing) of the second central pulley 11*c*'.

This pulley 11*d*' also comprises an outer annular portion 16*d*', adapted to cooperate with its own dedicated motor means 4*d*'.

The end annular crowns 16 of the different pulleys 11 are each structured in the form of an axial crown gear, adapted to cooperate with a complementary pinion gear 20 (FIG. 2) driven by the dedicated motor means 4.

These crown gears 16 are distributed on either side of the active cylindrical surface 5 of the drums 3: the crowns 16*a* and 16*b* are located on one side of the active cylindrical surface 5, and the crowns 16*c* and 16*d* are located on the other side.

The crowns 16*b* and 16*c* associated with the central pulleys 11*b* and 11*c* are located outwardly with respect to the two other crowns 16*a* and 16*d* of the outer pulleys 11*a* and 11*d*.

The motor means 4, each peculiar to one of the pulleys 11, are controlled by electronic/computer regulation means (not shown), configured to operate each of the pulleys 11 in rotation, in order to exert an appropriate tensile stress to the cable, while ensuring a progressive reduction of the tension and the elongation of the latter, from the first outer pulley 11*a* toward the second outer pulley 11*d*.

In this case, the motor means 4*a*" associated with the outer pulley 11*a*" of the second drum 3", on which is firstly wound, within the winch, the "high tension" side C' of the cable C, are driven by regulation means configured in speed-control mode.

The operation of the other pulleys 11*b*", 11*c*" and 11*d*" of this second drum 3" and the pulleys 11' of the first drum 3' is of the slave type with respect to the above-mentioned outer pulley 11*a*", thus forming the master pulley. These slave pulleys 11 are driven by regulation means configured in torque-control mode, i.e. so as to balance the torque thereof with respect to that of the master outer pulley 11*a*".

More precisely, the rotation direction and the torque of the master outer pulley 11*a*" are continuously detected. These data are processed by the torque regulation means, so that the motor means 4 associated with the slave pulleys apply to them a torque proportional to that of the master pulley 11*a*".

In practice, the cable is stored on a storage reel (not shown, located on the side of the drum 3') and is suitably wound on the two drums 3' and 3" of the winch 1, according to an arrangement of the helical type. In this case, the cable enters through the groove 6*a*" of the second drum 3" and exits from the groove 6*d*' of the first drum 3'.

More precisely, the cable is accommodated in the outer half-circle portion of each annular groove 6; and lower and upper cable strands, which are horizontal or substantially horizontal, pass from the annular groove 6 of one drum 3 to the annular groove 6 of the other drum 3, the upper strands passing from the groove 6 of a pulley 11 to the groove 6 of a following pulley 11 (toward the load side or the reel side).

When the operator wants to handle the cable (in the winding or unwinding direction), he just needs to control the rotational direction and speed of the master outer pulley 11*a*"; the so-called slave other pulleys 11 of the two drums 3 are then automatically driven, in a torque-regulation mode with speed limitation, as a function of the torque of the master pulley 11*a*".

The cable tension is progressively reduced from the pulleys 11*a* to the pulleys 11*d*. Indeed, the variation of elongation of each cable strand at each pulley 11 is absorbed by suitable rotations of each of these pulleys 11, which allow the limitation, or even the elimination, of the phenomena of friction of the strands within the corresponding grooves 6.

Moreover, the presence of only one groove 6 in the pulleys 11*a*, 11*b* and 11*c* cooperating with the portion of the cable "under high tension" enables the phenomena variation of the cable length in the region in which the cable undergoes the highest variations of tension and elongation to be followed-up at best. The friction phenomena are thereby reduced, or even eliminated.

Likewise, several grooves 6 are grouped together in the second outer pulley 11*d*, to complete the progressive reduction of the cable tension. As the variations of tension and elongation within these latter grooves 6 are limited, the fact that these grooves are grouped together in a same pulley 11*d* does not cause to the cable significant friction liable to damage the latter.

When the speed of the master pulley 11*a*" is brought back to zero, all the pulleys 11 are locked in position, by the activation of a suitable braking system (not shown).

Generally, the winch according to the invention has thereby the interest to have an optimum overall size, which is particularly important for limiting the loss of surface on ship desks or offshore platforms.

Moreover, this structure has the advantage that it particularly efficiently compensates for the cable elongation; this compensation is further improved by the automatic regulation of rotation of the different pulleys relative to each other.

It will be noticed that the outer pulley 11*d*, on the storage-reel side, may comprise an array of two to five annular grooves. The number of grooves in this pulley is in particular adapted as a function of the desired final reduction of tension.

It will also be noticed that the particular operation of the above-described winch (wherein the motor means of the "master" pulley are driven by regulation means configured in speed-control mode, and the motor means of the other pulleys are driven by regulation means configured in torque-control mode) may be implemented in other structures than the structure which is the object of the invention.

Still generally, the central pulleys are advantageously from two to six in number. This number of central pulleys is mainly chosen as a function of the elongation characteristics of the associated cable and of the tension stresses it undergoes: a very elastic cable being advantageously wound onto a greater number of pulleys so that its tension is efficiently reduced while limiting the phenomena of friction.

Further generally, if necessary, each pulley 11 may be associated with several motor elements, in particular to gain power, according to the load to be handled.

The invention claimed is:

1. A winch for pulling a cable (C), said winch (1) being intended to be associated with a reel for storing said cable, wherein said pulling winch (1) is composed of two motorized drums (3), placed opposite to each other, each comprising an active cylindrical peripheral drum surface (5) provided with several annular grooves (6), juxtaposed and coaxial to each other, said cable (C) being intended to be wound around said two drums (3) according to an arrangement of the helical type, strands of said cable passing successively from one of the annular grooves (6) of a drum (3) to one of the annular grooves (6) of the other drum (3), wherein said motorized drums (3) are each formed of at least three pulleys (11), which each comprise a cylindrical peripheral pulley surface (12) provided with at least one of said grooves (6) so as to each form a portion of said active cylindrical peripheral drum surface (5) of drum, i.e. two outer pulleys (11*a*, 11*d*), between which is arranged at least one central pulley (11 *b*, 11*c*), wherein the pulleys (11) are each rotationally mounted on a fixed axial bearing shaft (9), around a common central axis (10), and each cooperate with their own dedicated motor means (4), wherein said at least one central pulley (11*b*, 11*c*) comprises at least one axial extension (15), generally tubular in shape, so that said at least one central pulley (11 *b*, 11*c*) has a rotational central cylindrical surface (13*b*, 13*c*) adapted to cooperate with a complementary cylindrical surface (17) forming a bearing, and so that a cylindrical peripheral extension surface (17) of said at least one axial extension (15) forms a rotation bearing for the rotational central cylindrical surface (13) of at least one of said other pulleys (11), characterized in that a first central pulley (11 *b*) comprises two axial tubular extensions (15*b*1, 15*b*2) arranged on either side of its cylindrical peripheral pulley surface (12*b*) that is provided with a single groove (6*b*), and each forming a rotation bearing for the rotational central cylindrical surface (13) of at least one of said other pulleys (11).

2. A winch according to claim 1, characterized in that the complementary cylindrical surface forming a bearing of a central pulley (11 *c*) other than the first central pulley (11 *b*) cooperating with the fixed axial bearing shaft (9) corresponds to the cylindrical peripheral extension surface (17) of one of the axial extensions (15) of said first central pulley (11 *b*).

3. A winch according to claim 1, characterized in that at least one of the axial extension(s) (15*b*1, 15*c*) of the central pulleys (11 *b*, 11 *c*) also serves for the connection with the dedicated motor means (4).

4. A winch according to claim 1, characterized in that the two drums (3) each comprise a first outer pulley (11a) each provided with a single cylindrical groove (6*a*), intended to receive the cable under high tension (C'), on a load side, and in that the other outer pulley (11*d*) comprises an array of several grooves (6*d*), intended to receive the cable under low tension (C"), on a storage-reel side.

5. A winch according to claim 4, characterized in that the other outer pulley (11*d*) located on the storage-reel side comprises an array of two to five annular grooves (6*d*).

6. A winch according to claim 1, characterized in that the two drums (3) comprise from two to six central pulleys (11 *b*, 11 *c*), each provided with a single annular groove (6).

7. A winch according to claim 1, characterized in that the two drums (3) each comprise four pulleys (11):

the first central pulley (11*b*) comprising the rotational central cylindrical surface (13*b*) cooperating with the fixed axial bearing shaft (9), forming the rotation bearing thereof and the two axial tubular extensions (15*b*1, 15*b*2), forming bearings, one of said axial extensions (15*b*1) cooperating with its own dedicated motor means (4*b*), a first outer pulley (11*a*) comprising a rotational central cylindrical surface (13*a*) adapted to cooperate with the cylindrical peripheral extension surface (17*b*1) of a first axial tubular extension (15*b*1) of said first central pulley (11*b*), whose cylindrical peripheral pulley surface (12*a*) comprises a single groove (6*a*), and whose outer portion (16*a*) cooperates with its own motor means (4*a*), a second central pulley (11*c*) comprising a cylindrical peripheral pulley surface (12*c*) provided with a single groove (6*c*), a rotational central cylindrical surface (13*c*) adapted to cooperate with the cylindrical peripheral extension surface (17*b*2) of the second axial extension (15*b*2) forming a bearing of said first central pulley (11 *b*), and an axial tubular extension (15*c*) cooperating with its own motor means (4*c*), and a second outer pulley (11*d*) provided with a rotational central cylindrical surface (13*d*) adapted to cooperate with the axial tubular extension (15*c*) forming a bearing of said second central pulley (11 *c*), whose cylindrical peripheral pulley surface (12*d*) is provided with an array of grooves (6*d*), and whose outer portion (16*d*) cooperates with its own motor means (4*d*).

8. A winch according to claim 1, characterized in that at least one of the axial extension (15*b*1, 15*c*) of the central pulleys (11 *b*. 11 *c*), and the outer portions (16*a*, 16*d*) of the outer pulleys (11*a*, 11*d*), comprise an axial crown gear (16) adapted to cooperate with at least one complementary pinion gear (20), driven by dedicated motor means (4), said crown gears (16) being distributed on either side of the active cylindrical peripheral drum surface (5) of the drums (3).

9. A winch according to claim 1, characterized in that the motor means (4*a*") associated with the outer pulley (11 *a*") of one of said drums (3), a master pulley, receiving the cable under tension on a load side, are driven by regulation means configured in speed control mode, and in that the motor means (4) associated with the other pulleys, slave pulleys, are driven by regulation means configured in torque-control mode, their torque being a function of that of said master pulley.

10. A winch according to claim 1, characterized in that the two drums (3) are oriented angularly relative to each other, to avoid the twisting of the cable.

11. A winch according to claim 1, characterized in that the two drums (3) are carried by two vertical walls (2*a*) of a frame (2), wherein said frame (2) also forms a support structure for the driving motor means (4) of the pulleys (11) of the drum (3).

12. Equipment for pulling a cable, in particular a synthetic cable used offshore, comprising a winch (1) according to claim 1, associated with a storage reel.

13. A winch according to claim 2, characterized in that at least one of the axial extension(s) (15*b*1, 15*c*) of the central pulleys (11 *b*, 11 *c*) also serves for the connection with the dedicated motor means (4).

14. A winch according to claim 2, characterized in that the two drums (3) each comprise a first outer pulley (11*a*) each provided with a single cylindrical groove (6*a*), intended to receive the cable under high tension (C'), on a load side, and in that the other outer pulley (11*d*) comprises an array of several grooves (6*d*), intended to receive the cable under low tension (C"), on a storage-reel side.

15. A winch according to claim 3, characterized in that the two drums (3) each comprise a first outer pulley (11*a*) each provided with a single cylindrical groove (6*a*), intended to receive the cable under high tension (C'), on a load side, and in that the other outer pulley (11*d*) comprises an array of several grooves (6*d*), intended to receive the cable under low tension (C"), on a storage-reel side.

* * * * *